US006568905B2

(12) United States Patent
Horng et al.

(10) Patent No.: US 6,568,905 B2
(45) Date of Patent: May 27, 2003

(54) FAN WHEEL STRUCTURE FOR A BLOWER FAN

(75) Inventors: Alex Horng, Kaohsiung (TW); Ching-Shen Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 09/964,343

(22) Filed: Sep. 28, 2001

(65) Prior Publication Data

US 2003/0063973 A1 Apr. 3, 2003

(51) Int. Cl.[7] ..... F04D 29/28

(52) U.S. Cl. ..... 415/206; 416/185; 416/188; 416/223 B

(58) Field of Search ..... 416/185, 186 R, 416/188, 223 B; 415/204, 206

(56) References Cited

U.S. PATENT DOCUMENTS 3,893,817 A * 7/1975 Hackbarth et al. ..... 29/889.4
4,128,364 A * 12/1978 Papst et al. ..... 417/354

* cited by examiner

*Primary Examiner*—Edward K. Look
*Assistant Examiner*—Dwayne J. White
(74) *Attorney, Agent, or Firm*—Bacon & Thomas, PLLC

(57) ABSTRACT

A fan wheel structure comprises an annular wall, a central shaft extending along a central axis of the annular wall, an annular bottom plate extending outward from a bottom of the annular wall, and plural blades provided on the bottom plate. A joint area between the annular wall and the annular bottom plate is an annular arcuate wall to avoid interference with the air driven by the fan wheel, thereby providing a smoother airflow.

1 Claim, 5 Drawing Sheets

FAN WHEEL STRUCTURE FOR A BLOWER FAN

BACKGROUND OF THE INVENTION

1. Field of the Invention

The present invention relates to a fan wheel structure for a blower fan. In particular, the present invention relates to a fan wheel structure for a blower fan that drives air to flow in an improved, smoother manner.

2. Description of the Related Art

FIG. 1 of the drawings illustrates a conventional blower fan comprising a casing 90 having an axle tube 91 around which a stator 92 is mounted. A bearing 93 is mounted in the axle tube 91 for rotatably holding a central shaft 95 of a fan wheel 94. The fan wheel 94 comprises an annular wall 98 and an annular plate 96 extending radially outward from a bottom edge of the annular wall 98. Plural blades 97 are mounted upright on an annular outer edge of the annular plate 96 and spaced from the annular wall 98 by an appropriate gap. When the fan wheel 94 is driven to turn, air is sucked into the blower fan an exits via an outlet by the blades 97. Such a conventional blower fan creates a suction force for driving the air by means of a turbulent flow passing through a swirl passage in the casing 90. Therefore, the blowing effect largely depends on the smoothness of the flow. However, the joint area between the annular wall 98 and the annular plate 96 is at a right angle such that the sucked air would accumulate in the joint area and thus form turbulence.

Taiwan Utility Model Publication No. 388203, issued to Applicant on Apr. 21, 2000 and entitled AN WHEEL STRUCTURE as illustrated in FIG. 2 of the accompanying drawings of the present application, discloses a fan wheel 80 comprising plural axial flow blades 82 and plural blower blades 83 on an outer periphery of an annular wall 81 thereof. When the annular wall 82 turns, the axial flow blades 82 drives air along an axial direction while the blower blades 83 drives air along a direction orthogonal to the axial direction.

SUMMARY OF THE INVENTION

It is the primary object of the present invention to provide a fan wheel structure for a blower fan that drives air to flow in an improved, smoother manner, thereby providing an improved blowing effect.

The fan wheel structure in accordance with the present invention comprises an annular wall, a central shaft extending along a central axis of the annular wall, an annular bottom plate extending outward from a bottom of the annular wall, and plural blades provided on the bottom plate. A joint area between the annular wall and the annular bottom plate is an annular arcuate wall to avoid interference with the air driven by the fan wheel, thereby providing a smoother airflow.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
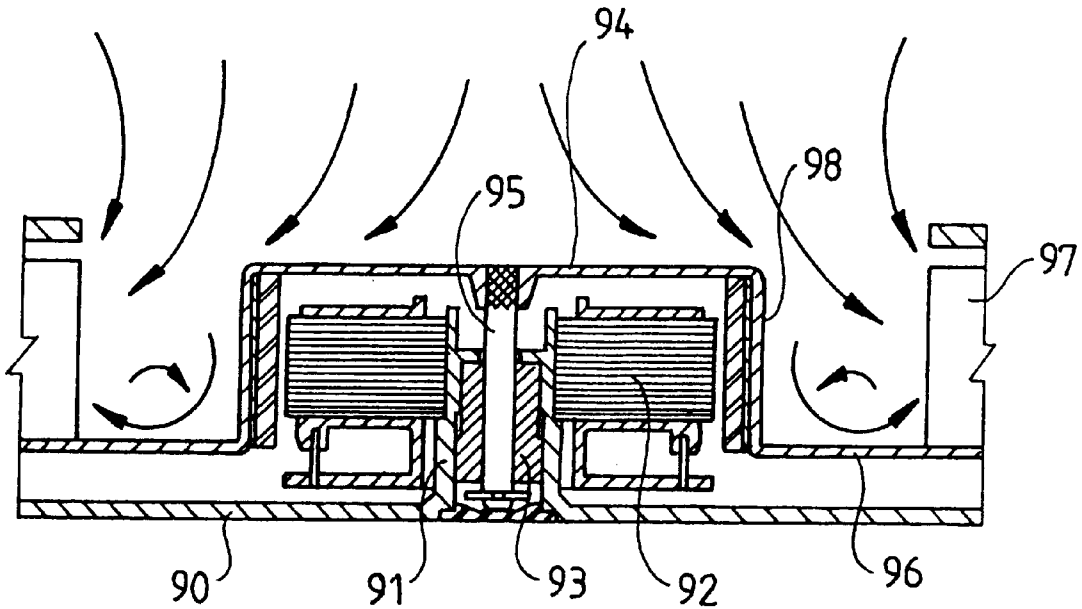
FIG. 1 PRIOR ART
FIG. 1 is a sectional view of a conventional blower fan.
Figure 2:
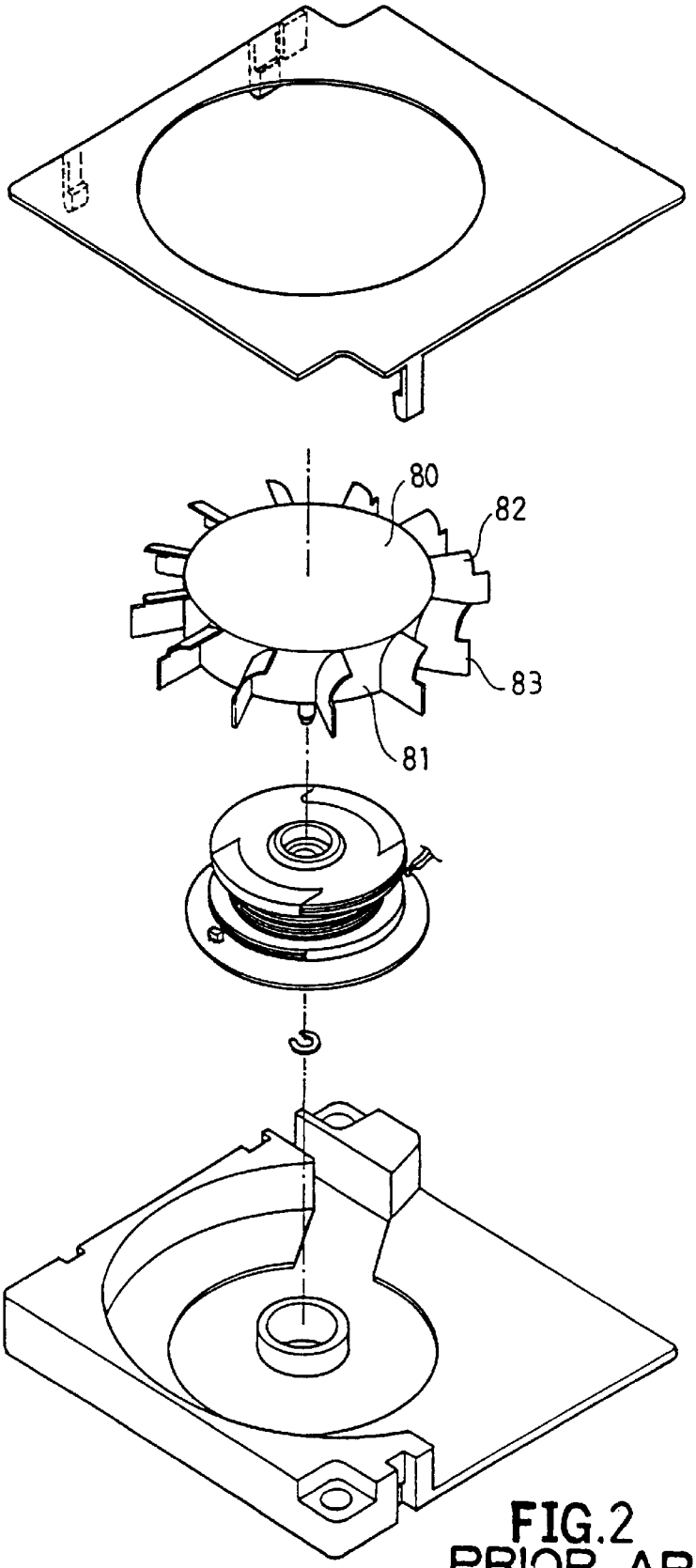
FIG.2 PRIOR ART
FIG. 2 is an exploded perspective view of another conventional blower fan.
Figure 3:
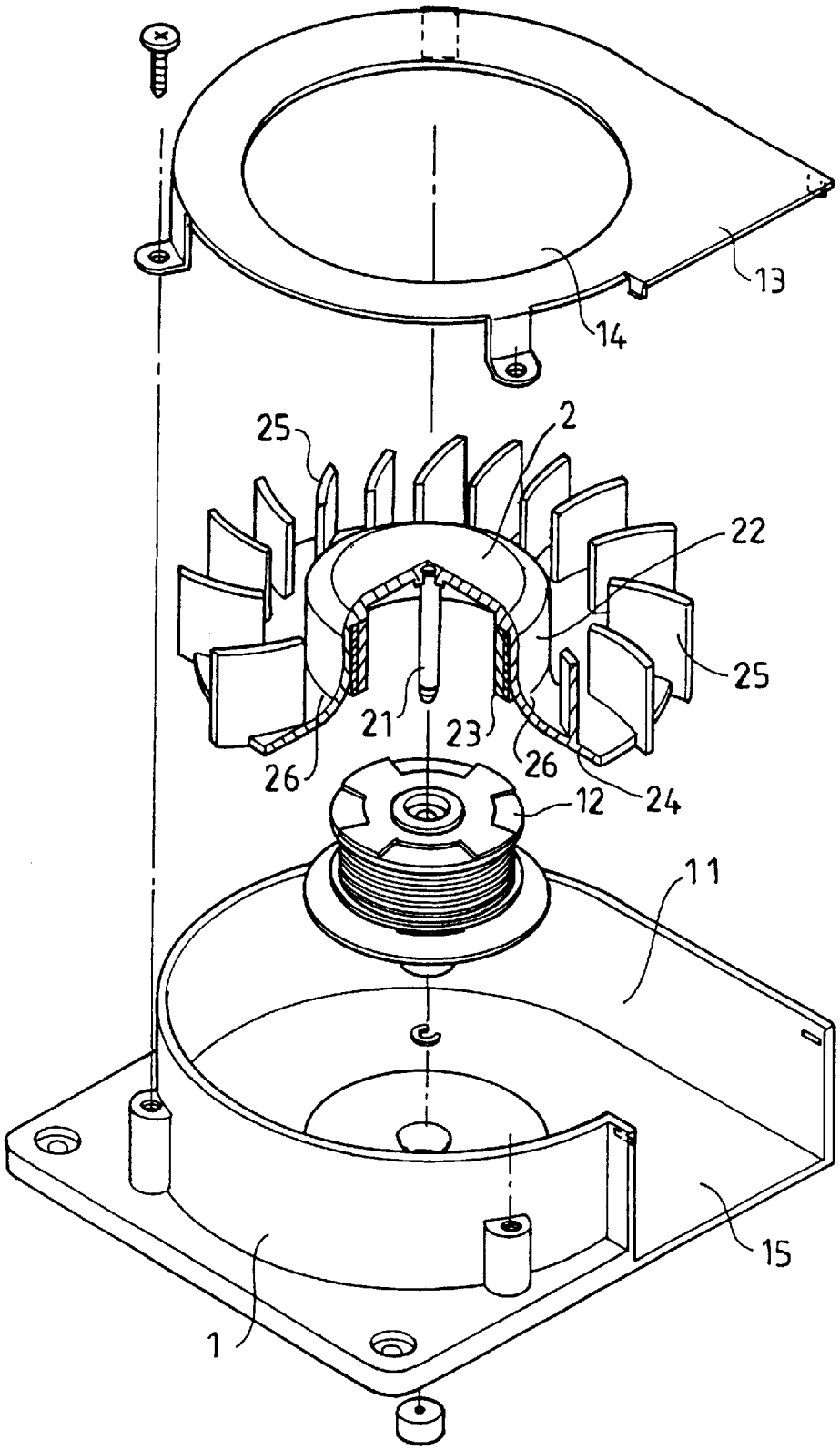
FIG. 3 is an exploded perspective view of a blower fan in accordance with the present invention.

Referring to FIG. 3, a blower fan in accordance with the present invention generally comprises a casing 1 defining a swirl passage 11 and a stator 12 mounted in the casing 1 for rotatably mounting a fan wheel 2. A lid 13 is provided to enclose the casing 1 and has an inlet 14 through which air is sucked into the swirl passage 11 and then exits the casing 1 via an outlet 15 located in a side of the casing 1.

The fan wheel 2 comprises an annular wall 22 and a central shaft 21 extending along a central axis of the annular wall 22. The central shaft 21 is rotatably mounted in the stator 12. A permanent ring magnet 23 is mounted to an inner periphery of the annular wall 22. An annular bottom plate 24 extends outward from a bottom of the annular wall 22 and plural upright blades 25 are mounted on the annular bottom plate 24 and spaced from the annular wall 22 to form an air inlet channel.

Figure 4:
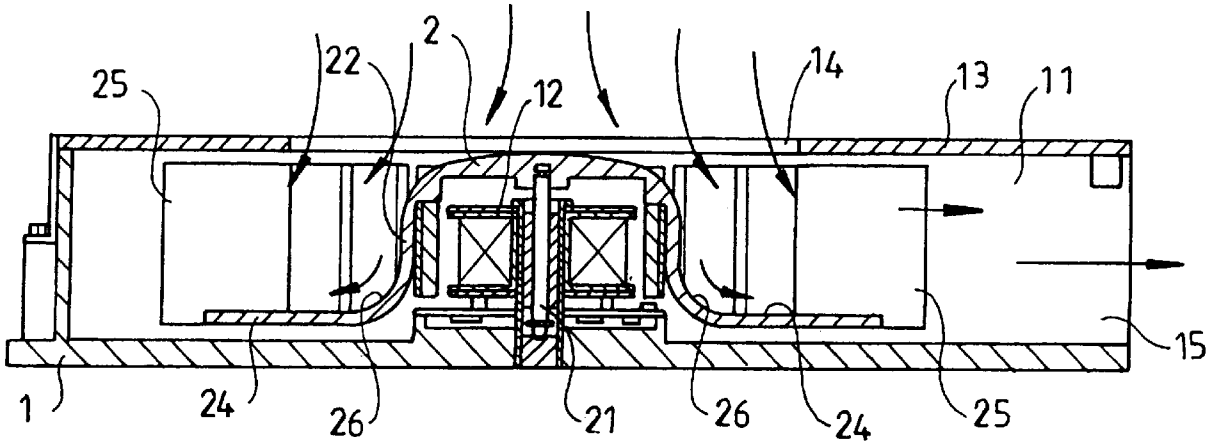
FIG. 4 is a sectional view of the blower fan in accordance with the present invention.
Figure 5:
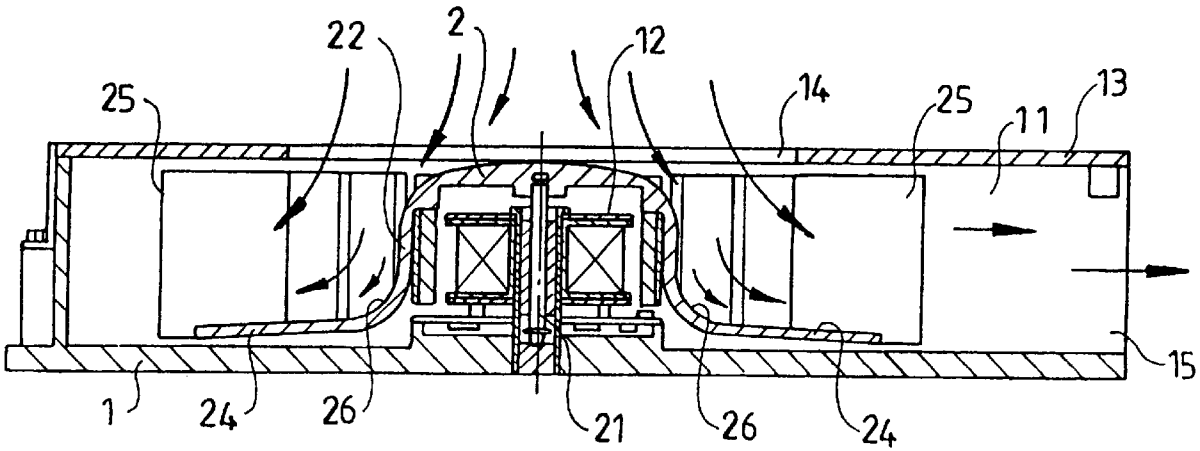
FIG. 5 is a sectional view similar to FIG. 4, illustrating a modified embodiment of the blower fan in accordance with the present invention.
Figure 6:
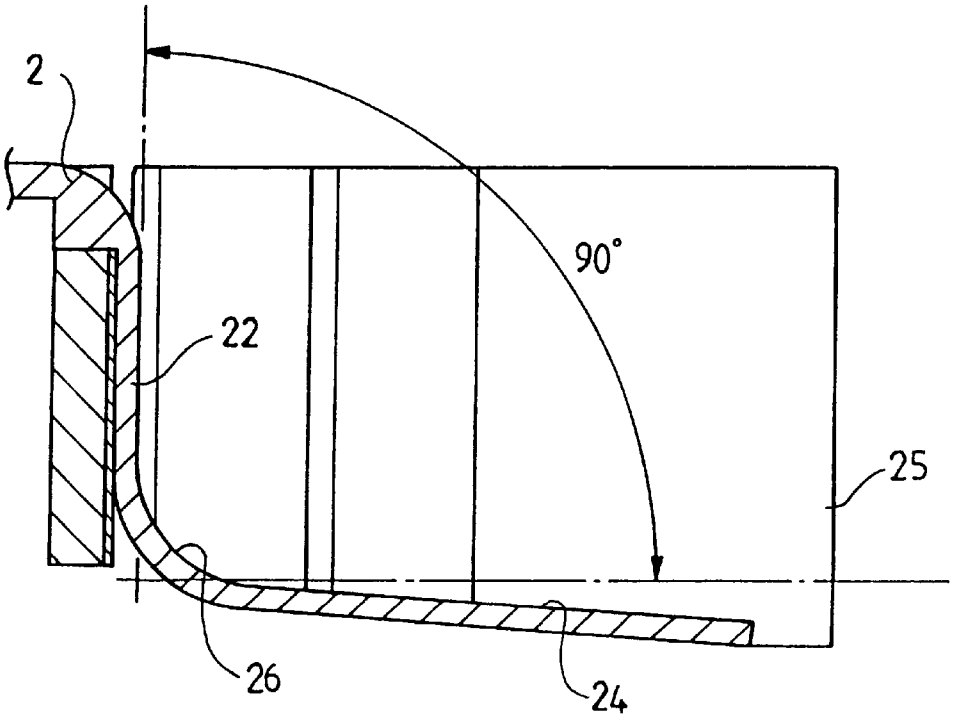
FIG. 6 is an enlarged sectional view illustrating an annular wall and an annular bottom plate of the blower fan in FIG. 5.

Referring to FIGS. 3 and 4, the main feature of the fan wheel in accordance with the present invention resides in that the annular wall 22 is not orthogonal to the annular bottom plate 24. A joint area between the annular wall 24 and the annular bottom plate 24 is an annular arcuate wall 26 that may directly extend from the annular wall 22 toward bottom plate 24 substantially across the bottom of the air inlet channel formed between annular wall 22 and blades 26, thereby providing a smooth air passage between the inlet 14 and the inlet 15 of the fan.

According to the above description, it is appreciated that the fan wheel structure in accordance with the present invention provides a smoother airflow passage for the driven air by means of providing an annular arcuate wall 26 between the annular wall 22 and the annular bottom plate 24. The airflow is even smoother when the angle between the annular bottom plate 24 and the annular wall 22 is obtuse by means of outward and downward extension of the annular bottom plate 24 away from the annular wall 22.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A fan wheel structure for a blower fan, the fan wheel structure comprising an annular wall having a bottom, a central shaft extending along a central axis of the annular wall, an inclined annular bottom plate extending outward from the bottom of the annular wall, and plural blades mounted on the annular bottom plate and space from the annular wall, a joint area between the annular bottom plate and the annular wall being an annular arcuate wall, wherein an inlet air channel is formed in a space between the annular wall and the blades, wherein the annular arcuate wall extends substantially across a bottom of the inlet air channel, and wherein the annular bottom plate slopes downward and away from the annular wall to form an obtuse angle therebetween.

* * * * *